US008770919B2

(12) United States Patent
Hashimoto et al.

(10) Patent No.: US 8,770,919 B2
(45) Date of Patent: Jul. 8, 2014

(54) TURBINE DISK AND GAS TURBINE

(75) Inventors: Shinya Hashimoto, Hyogo-ken (JP); Kenichi Arase, Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 953 days.

(21) Appl. No.: 12/864,006

(22) PCT Filed: Jan. 16, 2009

(86) PCT No.: PCT/JP2009/050551

§ 371 (c)(1),
(2), (4) Date: Jul. 22, 2010

(87) PCT Pub. No.: WO2009/107418

PCT Pub. Date: Sep. 3, 2009

(65) Prior Publication Data

US 2010/0290922 A1 Nov. 18, 2010

(30) Foreign Application Priority Data

Feb. 27, 2008 (JP) ..... 2008-046698

(51) Int. Cl.
*F01D 5/18* (2006.01)

(52) U.S. Cl.
USPC ..... 415/115; 416/97 R

(58) Field of Classification Search
USPC ..... 415/115, 116; 416/96 R, 97 R
See application file for complete search history.

(56) References Cited

U.S. PATENT DOCUMENTS 2,656,147 A * 10/1953 Denison Brownhill et al. ..... 416/97 R
5,984,636 A * 11/1999 Fahndrich et al. ..... 416/96 R
6,000,909 A * 12/1999 Hirokawa et al. ..... 416/96 R
6,022,190 A 2/2000 Schillinger
6,988,367 B2 * 1/2006 Thompson, Jr. et al. ..... 60/772
8,387,401 B2 * 3/2013 Hashimoto et al. ..... 60/806
2008/0199303 A1 8/2008 Thompson, Jr. et al.

FOREIGN PATENT DOCUMENTS

CN 1295184 A 5/2001
CN 1664331 A 9/2005
EP 1574670 A2 9/2005
GB 617472 A 2/1949

(Continued)

OTHER PUBLICATIONS

A KR Office Action, dated Jun. 22, 2012, issued in KR Application No. 10-2010-7018233.
Notice of Allowance issued in Korean Patent application No. 10-2010-7018233, mailed Dec. 28, 2012, 3 pages. (with Partial English translation).
Chinese Office Action for Application No. 200980106438.5 dated Jan. 28, 2013.

(Continued)

*Primary Examiner* — Nathaniel Wiehe
*Assistant Examiner* — Woody A Lee, Jr.
(74) *Attorney, Agent, or Firm* — Lowe Hauptman & Ham, LLP

(57) ABSTRACT

In a turbine disk and a gas turbine, the turbine disk is firmly connected to a rotor (24) to be rotatably supported; a plurality of rotor blades (22*a*) is arranged on an outer circumference thereof in a circumferential direction; first cooling holes (42) penetrating the turbine disk from inside toward outside thereof and being communicatively connected to a cooling passage (41) arranged inside of the rotor blades (22*a*) are arranged in the circumferential direction; second cooling holes (43) arranged between each of the first cooling holes (42) and penetrating the turbine disk from the inside toward the outside thereof are provided; and the first cooling holes (42) and the second cooling holes (43) are communicatively connected by way of a radial direction communicating channel (47), to alleviate concentration of stress and to improve durability.

4 Claims, 8 Drawing Sheets

(56) References Cited

FOREIGN PATENT DOCUMENTS

| | | | |
|---|---|---|---|
| JP | 62169201 | A | 10/1987 |
| JP | 231355 | A | 2/1990 |
| JP | 08218804 | A | 8/1996 |
| JP | 11247603 | A | 9/1999 |
| JP | 11257019 | A | 9/1999 |
| JP | 2001012205 | A | 1/2001 |
| WO | 2006115484 | A1 | 11/2006 |

OTHER PUBLICATIONS

International Search Report for Application No. PCT/JP2008/050551 issued Mar. 3, 2009.

Notification of the Grant of Patent Right for Invention dated Jul. 12, 2013 for Chinese application No. 200980106438.5.

Notification for Patent Registration Formalities dated Jul. 12, 2013 for Chinese application No. 200980106438.5.

Extended European Search Report issued Feb. 5, 2014, corresponds to European patent application No. 09715480.1.

* cited by examiner

TURBINE DISK AND GAS TURBINE

RELATED APPLICATIONS

The present application is based on, and claims priority from, International Application No. PCT/JP2009/050551 filed Jan. 16, 2009 and Japanese Application Number 2008-046698, filed Feb. 27, 2008, the disclosure of which is hereby incorporated by reference herein in its entirety.

TECHNICAL FIELD

The present invention relates to a turbine disk that is rotatably supported and has a plurality of rotor blades on an outer circumference thereof in a gas turbine in which, for example, fuel is supplied to compressed high temperature and high pressure air for combustion, and combustion gas thus generated is supplied to a turbine to obtain drive power for rotation, and to a gas turbine having such a turbine disk.

BACKGROUND ART

A gas turbine includes a compressor, a combustor, and a turbine. Air collected from an air inlet is compressed in the compressor to be turned into high temperature and high pressure compressed air. Fuel is supplied to the compressed air for combustion in the combustor. The high temperature and high pressure combustion gas drives the turbine, further to drive a generator that is connected to the turbine. The turbine includes a plurality of nozzles and rotor blades arranged in an alternating manner within a casing, and the rotor blades are driven by the combustion gas to drive an output shaft that is connected to the generator in rotation. The combustion gas that has driven the turbine is converted to a static pressure by way of a diffuser included in an exhaust casing, and then released into the air.

Recently, a gas turbine has come to be demanded to be highly efficient and have a high output, and there is a tendency that the temperature of the combustion gas guided to the nozzles and the rotor blades is increased more than ever. Therefore, generally, a cooling passage is formed inside the nozzles and the rotor blades, and a cooling medium, such as air or steam, is allowed to flow in the cooling passage to cool the nozzles and the rotor blades, to ensure the heat resistance as well as to enable an increase in the temperature of the combustion gas so that the output and the efficiency are improved.

For example, in the rotor blades, a plurality of rotor blade bodies each having a cooling passage formed inside is arranged along and fixed to an outer circumference of the turbine disk in a circumferential direction. Cooling holes are formed on the turbine disk in a radial direction, and leading ends of the cooling holes are connected to the cooling passages in the rotor blade bodies. The cooling medium is supplied into the cooling holes from the base ends thereof, and flows inside the cooling passage via the cooling holes to cool the rotor blade bodies.

Such a turbine cooling structure is disclosed in Patent Document 1 below, for example.

[Patent Document 1] Japanese Patent Application Laid-open No. H8-218804

DISCLOSURE OF INVENTION

Problem to be Solved by the Invention

On a turbine disk, because a plurality of rotor blades receives the combustion gas and is rotated at high speed, a tensile stress acts thereon by centrifugal force. In a conventional turbine cooling structure described above, because the same number of the cooling holes is formed on the turbine disk as that on the rotor blade bodies, the tensile stress acting on the turbine disk concentrates around the cooling holes. As a result, the durability of the turbine disk becomes insufficient, requiring some kinds of countermeasures, such as to use a highly strong material or to increase the thickness of the turbine disk, thus leading to a cost increase.

The present invention is made to solve such a problem, and an object of the present invention is to provide a turbine disk and a gas turbine that are improved in durability by alleviating the concentration of the stress thereon.

Means for Solving Problem

According to an aspect of the present invention, a turbine disk that is supported rotatably and in which a plurality of rotor blades is arranged on a circumference thereof in a circumferential direction, includes: a plurality of first cooling holes that penetrates the turbine disk from inside toward outside thereof, that is communicatively connected to a cooling passage provided inside of each of the rotor blades, and that is arranged in the circumferential direction; and second cooling holes that are positioned between each of the first cooling holes, and penetrate the turbine disk from the inside toward the outside thereof.

Advantageously, in the turbine disk, cooling gas is allowed to be supplied from base ends of the first cooling holes and the second cooling holes, and leading ends of the first cooling holes and the second cooling holes are communicatively connected to a radial direction communicating channel arranged in the circumferential direction.

Advantageously, in the turbine disk, a large number of fitting grooves arranged on an outer circumference in the circumferential direction are fitted with respective fitting protrusions on the rotor blades to form axial direction communicating channels in spaces between the fitting grooves and the rotor blades along an axial direction, the first cooling holes are arranged correspondingly to the axial direction communicating channels in the circumferential direction, and the leading ends thereof are communicatively connected to the radial direction communicating channel and the axial direction communicating channels, and the second cooling holes are arranged between the first cooling holes in the circumferential direction, and have the leading ends sealed, and are communicatively connected to the radial direction communicating channel.

Advantageously, in the turbine disk, both ends of the axial direction communicating channel are sealed with seal pieces.

Advantageously, in the turbine disk, the radial direction communicating channel is formed in an annular shape by sealing a ring-shaped communicating groove with a seal ring.

According to another aspect of the present invention, a gas turbine in which compressed air compressed in a compressor is combusted by supplying fuel thereto in a combustor, and a combustion gas thus generated is supplied to a turbine to obtain rotation drive power, includes a turbine disk that is rotatably supported; and a plurality of rotor blades arranged on an outer circumference of the turbine disk in a circumferential direction, and having a cooling passage inside. The turbine disk includes: a plurality of first cooling holes that penetrates the turbine disk from inside toward outside thereof, is communicatively connected to the cooling passage, and is arranged in the circumferential direction; and second cooling holes that are arranged between each of the first cooling holes, and penetrate the turbine disk from the inside toward the outside thereof.

Effect of the Invention

In the turbine disk according to the first aspect of the present invention, the first cooling holes penetrating the turbine disk from the inside toward the outside thereof and being communicatively connected to the cooling passage arranged inside each of the rotor blades are arranged in the circumferential direction; and the second cooling holes being positioned between each of the first cooling holes and penetrating the turbine disk from the inside toward the outside thereof are arranged. Therefore, in the turbine disk, the first cooling holes and the second cooling holes are arranged in an alternating manner to reduce the distance between a plurality of the cooling holes in the circumferential direction, further to alleviate the concentration of the stress acting around each of the cooling holes during the rotation. Furthermore, by arranging the second cooling holes, the weight can be reduced, and, as a result, the durability can be improved.

In the turbine disk according to the second aspect of the present invention, the cooling gas can be supplied from the base ends of the first cooling holes and the second cooling holes; and the leading ends of the first cooling holes and the second cooling holes are communicatively connected to the radial direction communicating channel arranged in the circumferential direction. Therefore, the cooling gas is supplied from the first cooling holes and the second cooling holes into the cooling passage in the rotor blade via the radial direction communicating channel. As a result, the area of the cooling gas passage can be increased, to reduce the pressure loss and to improve the efficiency of cooling the rotor blade.

In the turbine disk according to the third aspect of the present invention, a large number of the fitting grooves arranged on the outer circumference in the circumferential direction are fitted into respective fitting protrusions of the rotor blades to form axial direction communicating channels in spaces therebetween along an axial direction; and the first cooling holes are arranged correspondingly to the axial direction communicating channels in the circumferential direction, and the leading ends thereof are communicatively connected to the radial direction communicating channel and the axial direction communicating channels; and the second cooling holes are arranged between the first cooling holes in the circumferential direction, and have the leading ends sealed, and are communicatively connected to the radial direction communicating channel. As a result, the first cooling holes and the second cooling holes are arranged at appropriate positions, to enable the cooling gas to be supplied to the cooling passage in the rotor blade effectively, and the structure to be simplified.

In the turbine disk according to the fourth aspect of the present invention, the both ends of the axial direction communicating channels are sealed with the seal pieces. As a result, workability of the fitting grooves into which the blade roots of the rotor blades are fitted can thus be improved, and the seal pieces enable the axial direction communicating channels with no leakage to be formed appropriately.

In the turbine disk according to the fifth aspect of the present invention, the radial direction communicating channel is formed in an annular shape by sealing the ring-shaped communicating groove with the seal ring. As a result, by simplifying the structure of the radial direction communicating channel, the workability can be improved, and the seal piece enables the radial direction communicating channel with no leakage to be formed appropriately.

The turbine disk according to the sixth aspect of the present invention includes the compressor, the combustor, and the turbine, and the turbine includes: the turbine disk that is rotatably supported; and the rotor blades arranged on the outer circumference of the turbine disk, and having a cooling passage inside. The turbine disk further includes: the first cooling holes that penetrate the turbine disk from the inside toward the outside thereof, are communicatively connected to the cooling passage, and are arranged in the circumferential direction; and the second cooling holes that are arranged between each of the first cooling holes, and penetrate the turbine disk from the inside toward the outside thereof. Therefore, in the turbine disk, the first cooling holes and the second cooling holes are arranged in an alternating manner, to reduce the distance between a plurality of the cooling holes in the circumferential direction, further to alleviate the concentration of the stress acting around each of the cooling holes during the rotation. Furthermore, by arranging the second cooling holes, the weight can be reduced, and the durability can be improved. As a result, the output and the efficiency of the turbine can be improved.

EXPLANATIONS OF LETTERS OR NUMERALS

Figure 1:
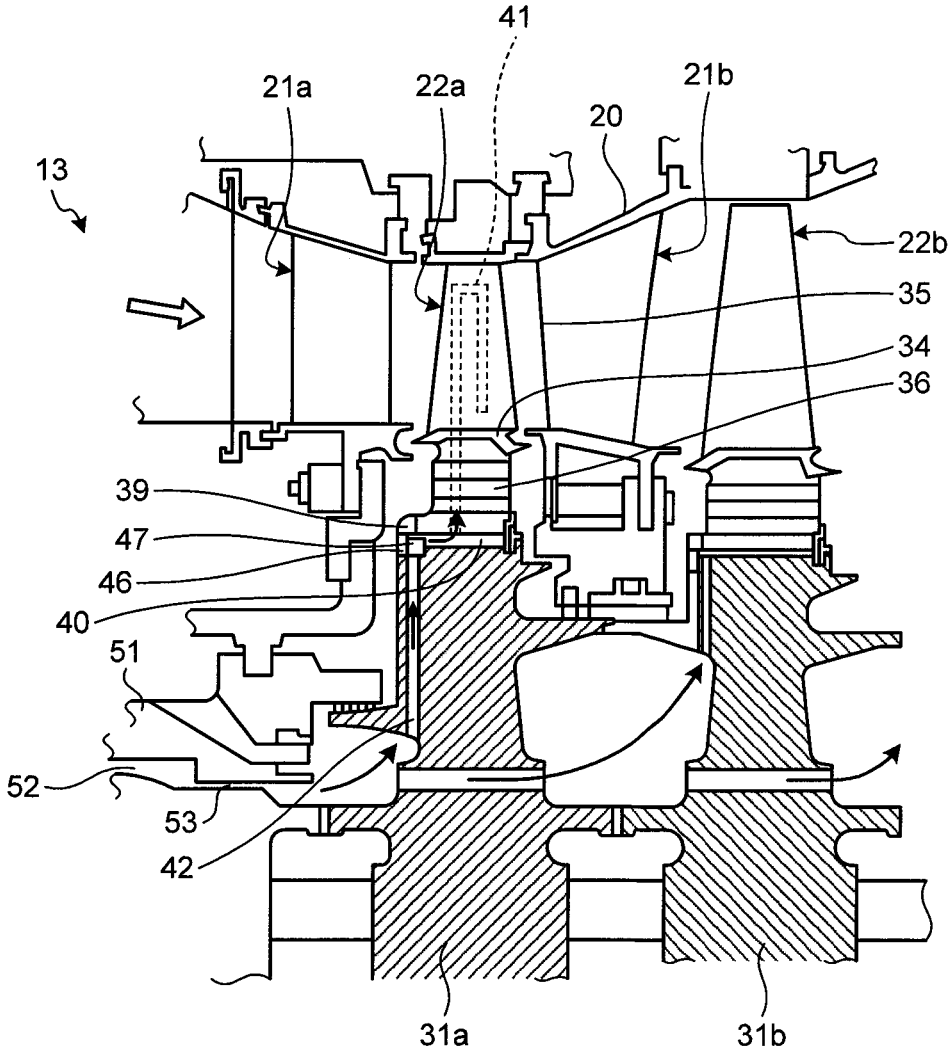
FIG. 1 is a schematic of an upstream portion of a turbine in a gas turbine according to an embodiment of the present invention.

11 compressor
12 combustor
13 turbine
14 exhaust chamber
21, 21*a*, 21*b* . . . nozzle
22, 22*a*, 22*b* . . . rotor blade
31*a*, 31*b* . . . turbine disk
32 fitting groove
36 blade root (fitting protrusion)
39 seal piece
40 axial direction communicating channel
41 cooling passage
42 first cooling holes
43 second cooling holes
44 plug
46 seal ring
47 radial direction communicating channel

BEST MODE(S) FOR CARRYING OUT THE INVENTION

An embodiment of a turbine disk and a gas turbine according to the present invention will now be explained in detail with reference to the attached drawings. The embodiment disclosed herein is not intended to limit the scope of the present invention in any way.

Embodiment

Figure 2:
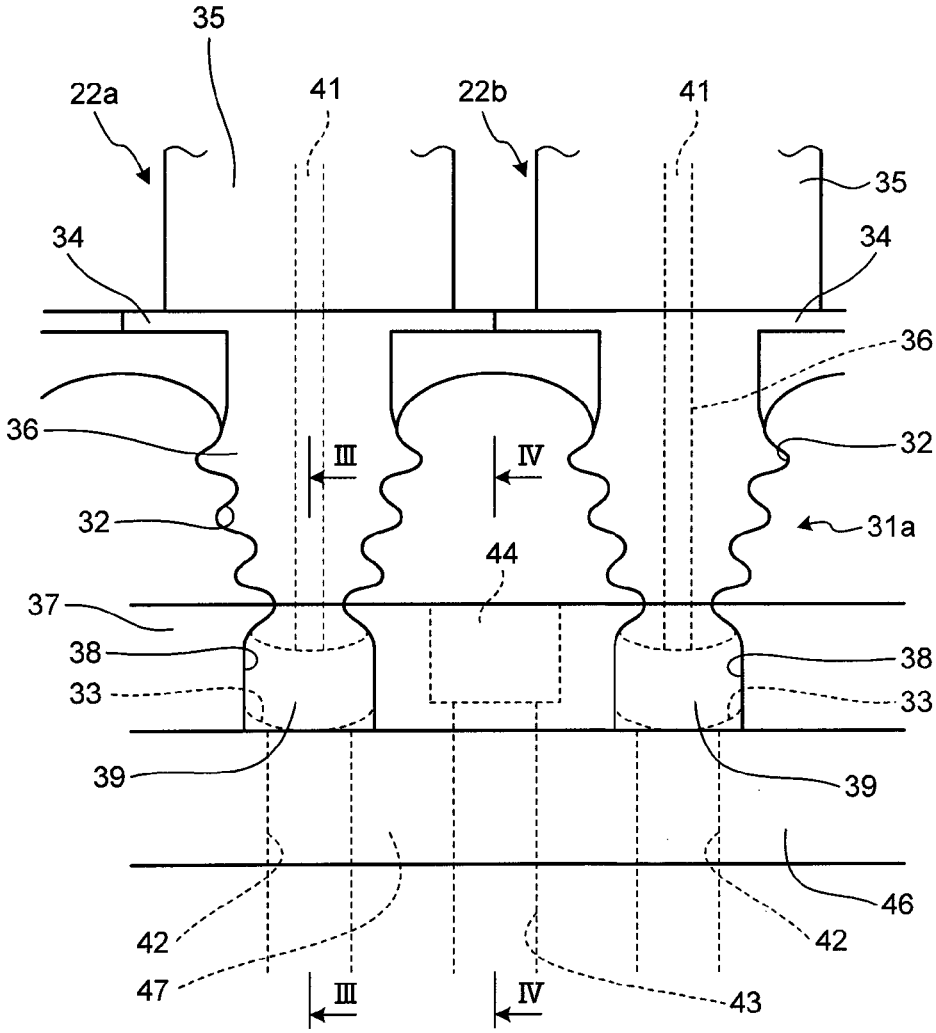
FIG. 2 is a front view of main parts of the turbine disk in the gas turbine according to the embodiment.
Figure 3:
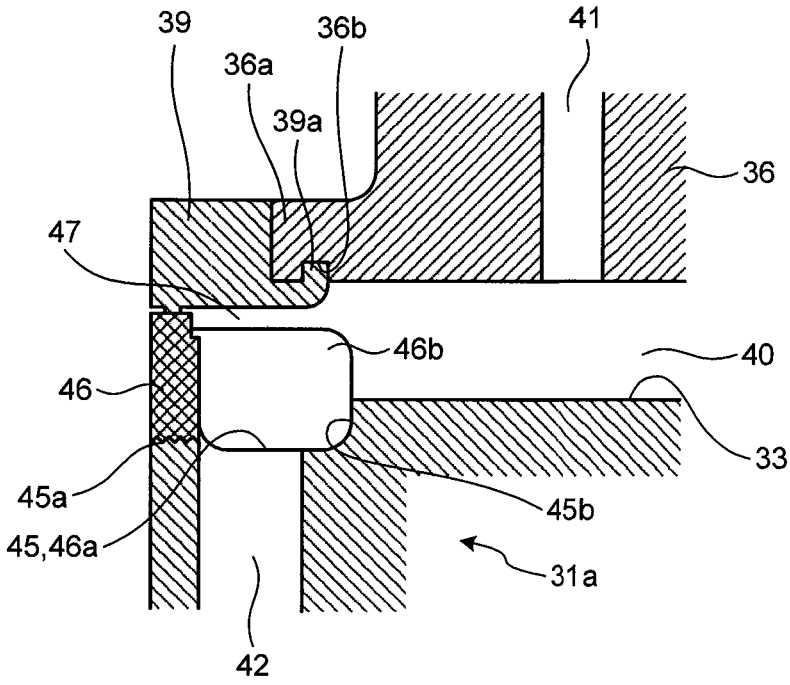
FIG. 3 is a cross-sectional view along a line in FIG. 2.
Figure 4:
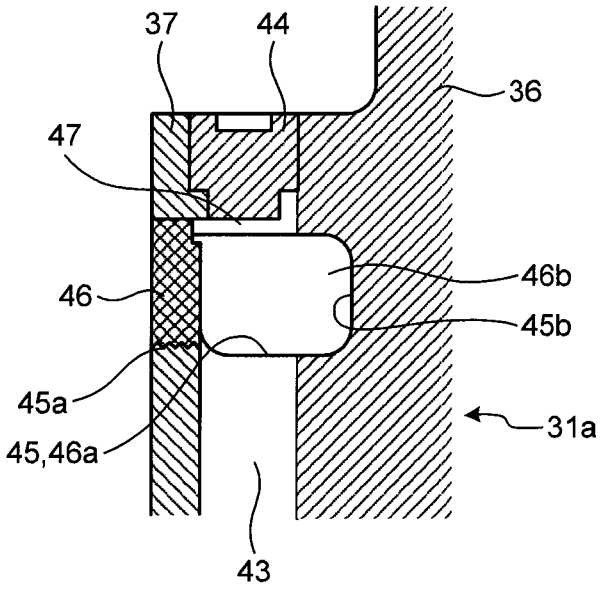
FIG. 4 is a cross-sectional view along a line IV-IV in FIG. 2.
Figure 5:
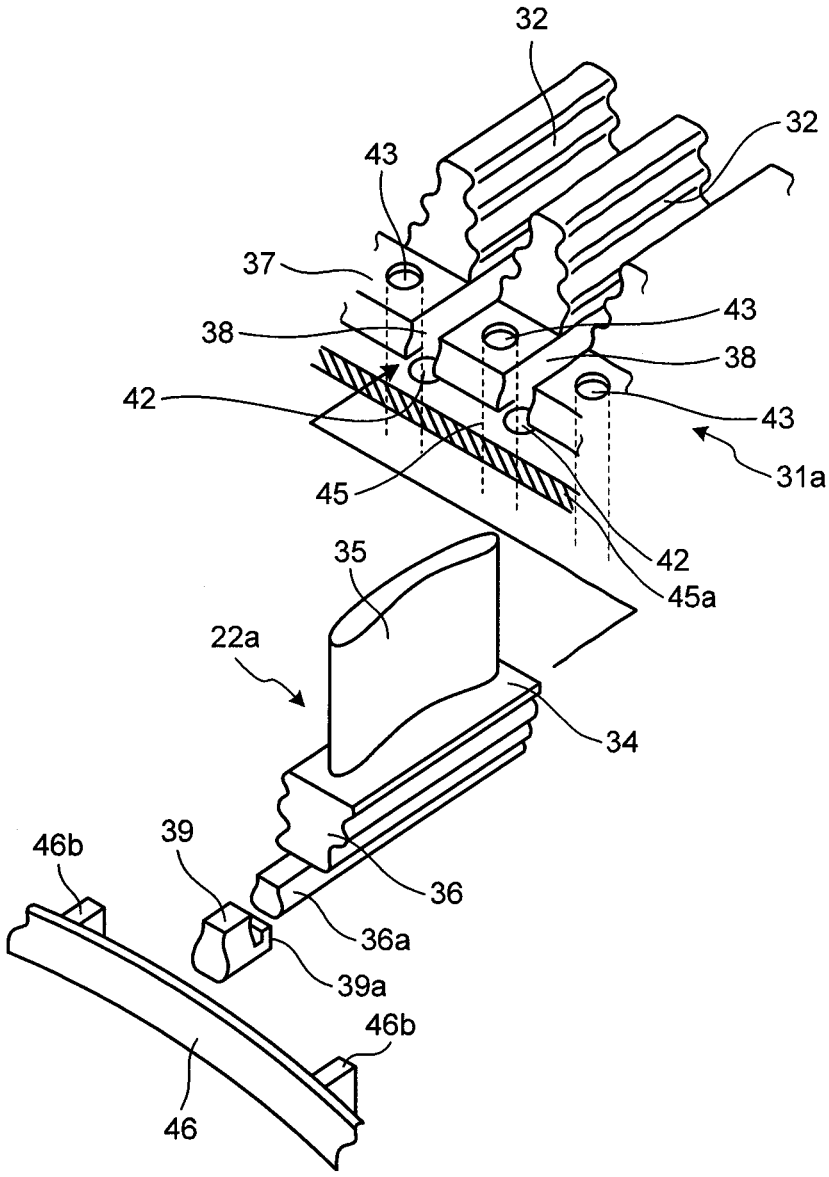
FIG. 5 is an exploded perspective view of a rotor blade in the gas turbine according to the embodiment.
Figure 6:
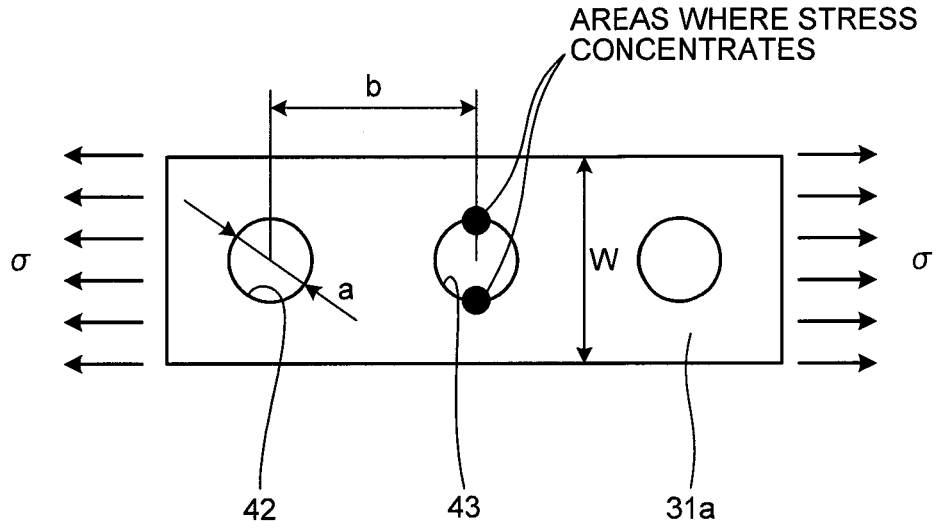
FIG. 6 is an illustrative schematic representing a relationship between the diameter of a cooling hole, the interval therebetween, and a stress concentration factor.
Figure 7:
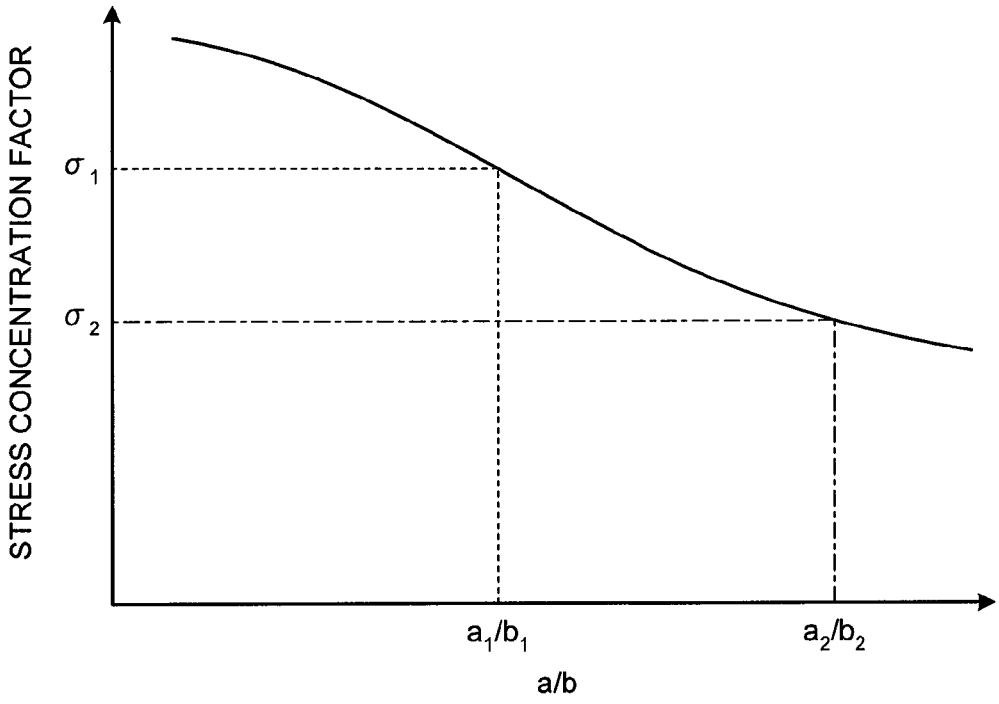
FIG. 7 is a graph indicating the stress concentration factor with respect to the diameter of the cooling holes and the interval therebetween.
Figure 8:
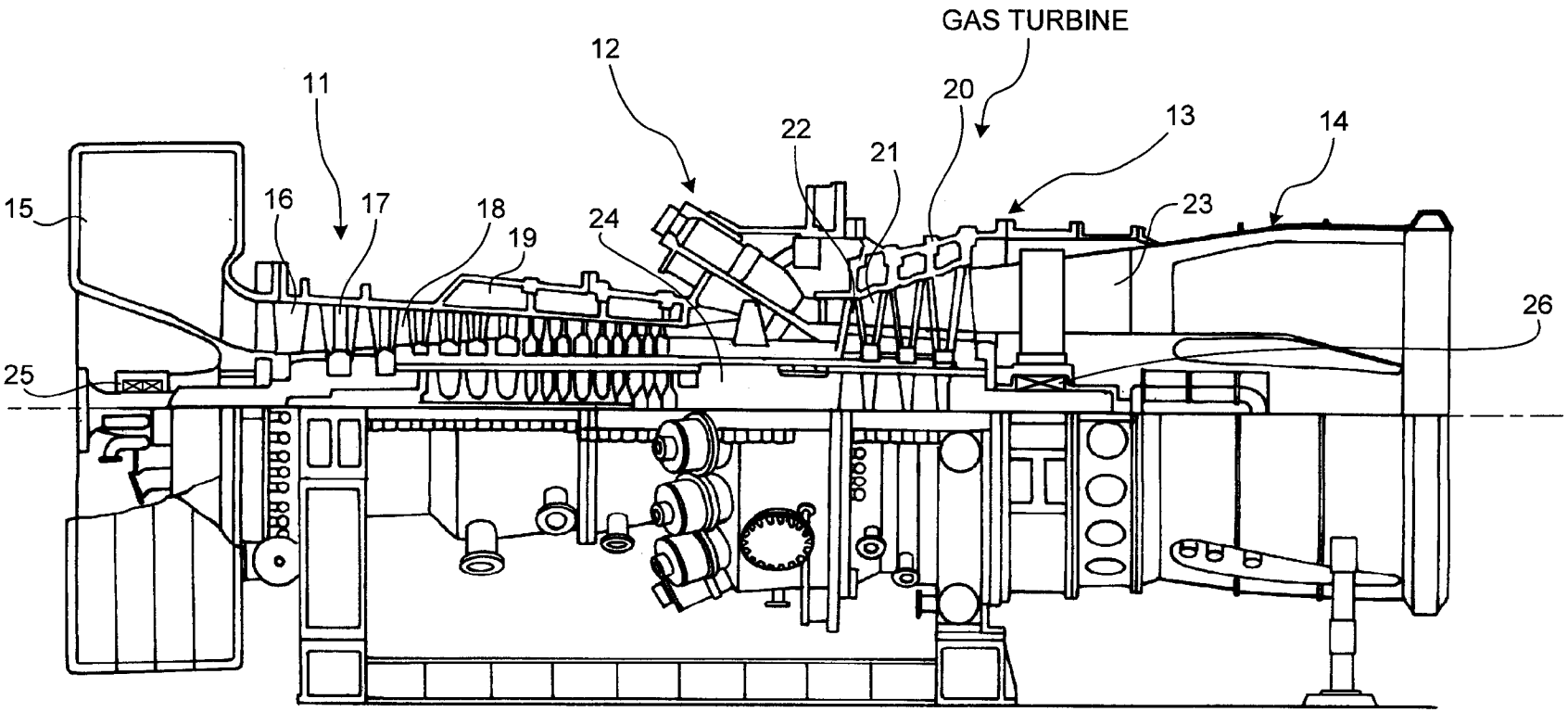
FIG. 8 is a schematic of a structure of the gas turbine according to the embodiment.
Figure 9:
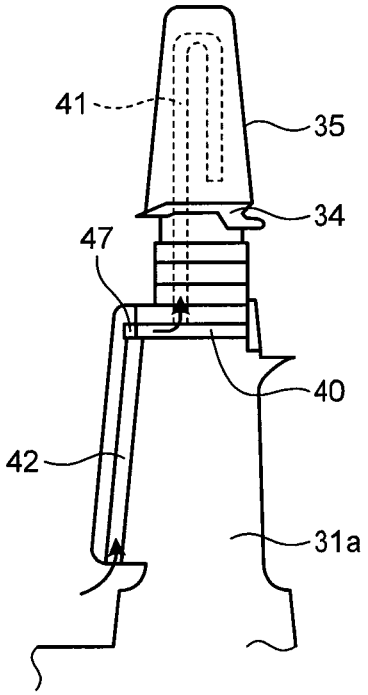
FIG. 9 is a schematic representing a variation of the turbine disk in the gas turbine according to the embodiment.

FIG. 1 is a schematic of an upstream portion of a turbine in a gas turbine according to an embodiment of the present invention; FIG. 2 is a front view of main parts of the turbine disk in the gas turbine according to the embodiment; FIG. 3 is a cross-sectional view along a line III-III in FIG. 2; FIG. 4 is a cross-sectional view along a line IV-IV in FIG. 2; FIG. 5 is an exploded perspective view of a rotor blade in the gas turbine according to the embodiment; FIG. 6 is an illustrative schematic representing a relationship between the diameter of a cooling hole, the interval therebetween, and a stress concentration factor; FIG. 7 is a graph indicating the stress concentration factor with respect to the diameter of the cooling holes and the interval therebetween; FIG. 8 is a schematic of a structure of the gas turbine according to the embodiment; and FIG. 9 is a schematic representing a variation of the turbine disk in the gas turbine according to the embodiment.

As illustrated in FIG. 8, the gas turbine according to the embodiment includes a compressor 11, a combustor 12, a turbine 13, and an exhaust chamber 14, and a generator not illustrated is connected to the turbine 13. The compressor 11 has an air inlet 15 that takes in air, and includes a plurality of compressor vanes 17 and rotor blades 18 arranged in an alternating manner within a compressor casing 16. An air bleeding manifold 19 is disposed outside thereof. The combustor 12 supplies fuel to compressed air that is compressed in the compressor 11, and burner ignition enables combustion. The turbine 13 includes a plurality of nozzles 21 and rotor blades 22 that are arranged in an alternating manner in a turbine casing 20. The exhaust chamber 14 includes an exhaust diffuser 23 continuing to the turbine 13. A rotor (turbine shaft) 24 is positioned penetrating through the centers of the compressor 11, the combustor 12, the turbine 13, and the exhaust chamber 14, and an end of the rotor 24 toward the compressor 11 is supported rotatably on a bearing 25, and the other end toward the exhaust chamber 14 is supported rotatably on a bearing 26. A plurality of disks are fixed to the rotor 24, and each of the rotor blades 18 and 22 are also fixed thereto, and a drive shaft of the generator, not illustrated, is connected to an end toward the exhaust chamber 14.

Air collected via the air inlet 15 on the compressor 11 passes through the nozzles 21 and the rotor blades 22 and is compressed thereby to become compressed air having a high temperature and a high pressure. A predetermined fuel is injected to the compressed air for combustion in the combustor 12. Combustion gas that is a working fluid at a high temperature and a high pressure generated in the combustor 12 passes through the nozzles 21 and the rotor blades 22 included in the turbine 13 to drive the rotor 24 in rotation, further to drive the generator connected to the rotor 24. Exhaust gas is converted into static pressure in the exhaust diffuser 23 in the exhaust chamber 14, and then released into the air.

In the turbine 13, as illustrated in FIG. 1, the nozzles 21*a*, 21*b*, . . . are arranged in a flowing direction of fuel gas (in the direction indicated by an arrow in FIG. 1) in the turbine casing 20. Each of the nozzles 21*a*, 21*b*, . . . are laid equally spaced therebetween along the circumferential direction of the turbine casing 20. Turbine disks 31*a*, 31*b*, . . . are connected to the rotor 24 (see FIG. 8) in an integrally rotatable manner along an axial direction. Each of the turbine disks 31*a*, 31*b*, . . . has the rotor blades 22*a*, 22*b*, . . . fixed to the outer circumference thereof. Each of the rotor blades 22*a*, 22*b* . . . are arranged equally spaced therebetween along the circumferential direction on each of the turbine disks 31*a*, 31*b*, . . . .

In FIG. 5, the turbine disk 31*a* has a disk-like shape, and a plurality of fitting grooves 32, each of which is laid in the axial direction, is formed equally spaced therebetween in the circumferential direction on the outer circumference of the turbine disk. At the bottom of each of the fitting grooves 32, an axial direction communicating groove 33 is formed integrally with the fitting groove 32. In the rotor blade 22*a*, a rotor blade body 35 is arranged upright integrally on top of a platform 34. A blade root (fitting protrusion) 36 that can be fitted into the fitting groove 32 is formed integrally to the bottom of the platform 34. A protrusion 36*a*, protruding toward one side in the axial direction, is formed integrally to the bottom of the blade root 36.

On the turbine disk 31*a*, a ring-shaped circumferential flange 37 is formed on one side of the turbine disk 31*a* in the axial direction (on the front edge side). Cutouts 38 each of which positioned along the same line as each of the axial direction communicating grooves 33 are formed in the circumferential flange 37. The protrusion 36*a* on the blade root 36 can be fitted into the cutout 38 on the turbine disk 31*a*, and a seal piece 39 can be fitted thereto.

The blade root 36 is slid and fitted into the fitting groove 32 to mount the rotor blades 22*a* to the turbine disk 31*a*. To explain using FIG. 3, at this time, a space is formed between the bottom surface of the blade root 36 and the axial direction communicating groove 33, to form an axial direction communicating channel 40. A cooling passage 41 that is formed inside the rotor blade 22*a* is communicatively connected to the axial direction communicating channel 40. The protrusion 36*a* on the blade root 36 fits into the cutout 38 on the turbine disk 31*a*, and the seal piece 39 is fitted thereto from outside to seal a part of one side of the axial direction communicating channel 40. The seal piece 39 has a hook 39*a* bending from a horizontal direction toward an upright direction, and the hook 39*a* is locked into a cutout 36*b* on the blade root 36 with the blade root 36 fitted into the cutout 38, thus the seal piece 39 is prevented from falling off. The other side (rear edge side) of the axial direction communicating channel 40 is also sealed by a seal piece not illustrated fitted therein.

On the turbine disk 31*a*, a plurality of first cooling holes 42 each of which penetrates the turbine disk from inside toward outside thereof and is communicatively connected to the cooling passage 41 in each of the rotor blade 22*a* is arranged in the circumferential direction. On the turbine disk 31*a*, a plurality of second cooling holes 43 each of which is located between the first cooling holes 42 and penetrates the turbine disk from the inside toward the outside thereof is arranged in the circumferential direction. The first cooling holes 42 are arranged correspondingly to the axial direction communicating channels 40; the base ends thereof open into the inside of the turbine casing 20; and the leading ends thereof are communicatively connected to the axial direction communicating channels 40. Referring to FIG. 4, the base ends of the second cooling hole 43 open into the inside of the turbine casing 20, in the same manner as the first cooling hole 42. The leading ends of the second cooling holes 43 penetrate through the circumferential flange 37, and are sealed by a plug 44 that is attached thereto.

Referring to FIGS. 3 to 5, a ring-shaped radial direction communicating groove 45 is formed on an outer circumferential plane of the turbine disk 31*a*. A seal ring 46 is fixed to and seals an opening end of the radial direction communicating groove 45 to form an annular radial direction communicating channel 47. The radial direction communicating groove 45 runs across and is communicatively connected to each of the first cooling holes 42 and the second cooling holes 43. As illustrated in FIGS. 3 and 4, a screw portion 46*a* that is screwed into a screw portion 45*a* on the radial direction communicating groove 45 is formed on the inner circumference of the seal ring 46. On the side surface of the radial direction communicating channel, a plurality of aligning protrusions 46*b* that can be brought in contact with a bottom 45*b* of the radial direction communicating groove 45 is formed with a predetermined space therebetween in the circumferential direction.

Therefore, by way of the screw portion 46*a* being rotated so as to be screwed into the screw portion 45*a* and bringing the aligning protrusion 46*b* into contact with the bottom 45*b* of the radial direction communicating groove 45, the seal ring 46 is aligned and fixed, to form the radial direction communicating channel 47. Each of the tip ends of the first cooling holes 42 and the second cooling holes 43 is communicatively connected by way of the radial direction communicating channel 47. The radial direction communicating channel 47 is communicatively connected to the axial direction communicating channels 40.

In the explanation above, the rotor blade 22*a* and the turbine disk 31*a* at the first stage are described; however, the rotor blades 22*b* . . . and the turbine disks 31*b* . . . at the second stage and thereafter also have the same structures.

Referring to FIG. 1, a cavity 52 partitioned by the turbine disk 31*a* and a cover 51 is arranged inside the turbine casing 20. Cooling air that has been bled from the compressor 11 and cooled is supplied into the cavity 52. The compressed air compressed in the compressor 11 (see FIG. 8) is sent into a cooler (not illustrated), cooled therein to a predetermined temperature, and then sent into the cavity 52. The cooling air (cooling gas) sent to the cavity 52 is sucked into each of the cooling holes 42 and 43 through a restrictor 53.

In the turbine 13 according to the embodiment having such a structure, the cooling air is supplied into the axial direction communicating channels 40 through the first cooling holes 42, and from the radial direction communicating channel 47 into the axial direction communicating channels 40 through the second cooling holes 43. By way of the cooling air being supplied from the axial direction communicating channels 40 to the cooling passages 41, the rotor blades 22*a* are cooled.

On the turbine disk 31*a*, because the first cooling holes 42 and the second cooling holes 43 are formed in an alternating manner along the circumferential direction thereof, and because the distance between the cooling holes 42 and 43 are thus reduced, the concentration of the stress can be reduced. As illustrated in FIG. 6, it is assumed herein that the inner diameter of the cooling holes 42 and 43 is a; and the distance between the centers of the adjacent cooling holes 42 and 43 is b; and the stress concentration factor is $\sigma$. As illustrated in FIG. 7, there is a tendency that, the greater a/b is, the smaller the stress concentration factor $\sigma$ becomes. In a conventional turbine disk in which only the first cooling holes are formed, because the distance between the centers of the adjacent first cooling holes $b_1$ is large, the stress concentration factor $\sigma_1$ becomes high in relation to $a_1/b_1$. On the contrary, in the turbine disk 31*a* according to the embodiment in which the first cooling holes 42 and the second cooling holes 43 are formed in an alternating manner, because the distance $b_2$ between the centers of the adjacent cooling holes 42 and 43 is short, the stress concentration factor $\sigma_2$ is reduced in relation to $a_2/b_2$.

As described above, the turbine disk 31*a* according to the embodiment is firmly connected to the rotor 24; the rotor 24 is supported rotatably; a plurality of the rotor blades 22*a* is arranged along the outer circumference of the turbine disk 31*a* in the circumferential direction; the first cooling holes 42 each of which penetrates the turbine disk from inside toward outside thereof and is communicatively connected to the cooling passage 41 inside the rotor blades 22*a* are arranged in the circumferential direction in the turbine disk 31*a*; and the second cooling holes 43 are arranged between the respective first cooling holes 42 and penetrate the turbine disk from inside toward outside thereof.

Therefore, in the turbine disk 31*a*, the first cooling holes 42 and the second cooling holes 43 are arranged in an alternating manner along the circumferential direction to reduce the distance between a plurality of cooling holes 42 and 43 in the circumferential direction. Therefore, the concentration of the stress applied to the area around each of the cooling holes 42 and 43 upon rotating the rotor can be alleviated. Furthermore, by adding the second cooling holes 43, the turbine disk 31*a* can be reduced in weight. As a result, durability of the turbine disk 31*a* can be improved.

Furthermore, in the turbine disk according to the embodiment, the first cooling holes 42 and the second cooling holes 43 allow the cooling gas to be supplied from the base ends thereof; the leading ends of the first cooling hole 42 and the second cooling holes 43 are communicatively connected via the radial direction communicating channel 47 that is laid along the circumferential direction. In this manner, the cooling gas is supplied from the first cooling holes 42 and the second cooling holes 43 into the cooling passage 41 in the rotor blade 22*a* via the radial direction communicating channel 47. As a result, the area of the cooling gas passage can be increased, to reduce the pressure loss and to improve the efficiency of cooling the rotor blade 22*a*.

Furthermore, in the turbine disk according to the embodiment, the blade roots 36 of the rotor blades 22*a* are fitted into a large number of respective fitting grooves 32 arranged in the outer circumference of the turbine disk in the circumferential direction to form the axial direction communicating channels 40 in the space therebetween along the axial direction; the first cooling holes 42 are arranged correspondingly to the axial direction communicating channels 40 in the circumferential direction, and the leading ends thereof are communicatively connected to the radial direction communicating channel 47 and the axial direction communicating channels 40; the second cooling holes 43 are arranged between the first cooling holes 42 in the circumferential direction, and the leading ends thereof are sealed with the plug 44 and are communicatively connected to the radial direction communicating channel 47; and the first cooling holes 42 and the second cooling holes 43 are arranged at appropriate positions to supply the cooling gas to the cooling passage 41 in the rotor blade 22*a* effectively. The structure can thus be simplified.

Furthermore, in the turbine disk according to the embodiment, both ends of the axial direction communicating channel 40 are sealed with the seal pieces 39. Workability of the fitting groove 32 into which the blade root 36 of the rotor blade 22*a* is fitted can thus be improved. The seal piece 39 enables the axial direction communicating channel 40 with no leakage to be formed appropriately.

Furthermore, in the turbine disk according to the embodiment, the radial direction communicating channel 47 is provided in an annular shape by sealing the ring shaped radial direction communicating groove 45 with the seal ring 46. By simplifying the structure of the radial direction communicating channel 47, the workability can be improved. The seal ring 46 enables the radial direction communicating channel 47 with no leakage to be formed appropriately.

Furthermore, the gas turbine according to the embodiment includes the compressor 11, the combustor 12, and the turbine 13. The turbine 13 includes the turbine disks 31*a*, 31*b*, . . . that are supported rotatably; and a plurality of the rotor blade 22*a*, 22*b*, . . . that is arranged in the outer circumference of the turbine disks 31*a*, 31*b*, . . . and has a cooling passage 41 formed therein. In the turbine disks 31*a*, 31*b*, . . . , a plurality of the first cooling holes 42 each of which penetrates the turbine disk from the inside toward the outside thereof and is communicatively connected to the cooling passage 41 is arranged, and the second cooling holes 43 each of which is positioned between the first cooling holes 42 and that penetrates the turbine disk from the inside toward the outside thereof are arranged.

In this manner, in the turbine disks 31*a*, 31*b*, . . . , the first cooling holes 42 and the second cooling holes 43 are arranged in an alternating manner in the circumferential direction, to reduce the distance between the cooling holes 42 and 43 in the circumferential direction; the concentration of the stress applied upon rotating the rotor to the area around each of the cooling holes 42 and 43 can be alleviated. Furthermore, by adding the second cooling holes 43, the turbine disk 31*a* can be reduced in weight to improve the durability. As a result, the output and the efficiency of the turbine can be improved.

In the embodiment described above, in the turbine disk 31*a*, the first cooling holes 42 are arranged from the inside toward the outside of the turbine disk, and the second cooling holes 43 are arranged between the first cooling holes 42 from the inside toward the outside of the turbine disk; however, the structure is not limited thereto. For example, in the turbine disk, a plurality of the second cooling holes may be arranged between the first cooling holes, or the inner diameter of the second cooling hole may be made smaller than that of the first cooling hole. The shape of the first cooling hole 42 and the second cooling holes 43 is not limited to a circle, but may also be another shape, such as an ellipse.

Furthermore, the first cooling holes 42 and the second cooling holes 43 arranged from the inside toward the outside of the turbine disk may also be arranged tilted in the axial direction with respect to the circumferential direction, as illustrated in FIG. 9. On the outside of the rotor disk, the concentration of the stress around the openings of the cooling holes can be alleviated.

Furthermore, in the embodiment described above, the second cooling holes according to the present invention are explained to be the second cooling holes 43 arranged between the first cooling holes 42 in the turbine disk 31*a*; however, the second cooling holes 43 may be second cooling holes with leading ends thereof sealed, without providing the radial direction communicating channel 47. Such a structure can also alleviate the concentration of the stress acting on the turbine disk, and can reduce the weight as well.

INDUSTRIAL APPLICABILITY

The turbine disk and the gas turbine according to the present invention improves the durability by alleviating the concentration of the stress acting on the turbine disk, and can be applied to any type of gas turbines.

The invention claimed is:

1. A turbine disk that is supported rotatably and in which a plurality of rotor blades is arranged on a circumference thereof in a circumferential direction, the turbine disk comprising:

a plurality of first cooling holes that penetrates the turbine disk from inside toward outside thereof in a radial direction of the turbine disk, that is communicatively connected to a cooling passage provided inside of each of the rotor blades, and that is arranged in the circumferential direction; and a plurality of second cooling holes that are positioned between each of the first cooling holes, and penetrates the turbine disk from the inside toward the outside thereof in a radial direction of the turbine disk, wherein base ends of the first cooling holes and the second cooling holes are configured to receive cooling gas, leading ends of the first cooling holes and the second cooling holes are communicatively connected to a radial direction communicating channel arranged in the circumferential direction, a plurality of fitting grooves arranged on an outer circumference in the circumferential direction are fitted with respective fitting protrusions on the rotor blades to form axial direction communicating channels in spaces between the fitting grooves and the rotor blades along an axial direction, the first cooling holes are arranged correspondingly to the axial direction communicating channels in the circumferential direction, and the leading ends thereof are communicatively connected to the radial direction communicating channel and the axial direction communicating channels, and the second cooling holes are arranged between the first cooling holes in the circumferential direction, and have the leading ends sealed, and are communicatively connected to the radial direction communicating channel.

2. The turbine disk according to claim 1, wherein both ends of the axial direction communicating channel are sealed with seal pieces.

3. The turbine disk according to claim 1, wherein the radial direction communicating channel is formed in an annular shape by sealing a ring-shaped communicating groove with a seal ring.

4. A gas turbine in which compressed air compressed in a compressor is combusted by supplying fuel thereto in a combustor, and a combustion gas thus generated is supplied to a turbine to obtain rotation drive power, wherein the turbine comprises a turbine disk that is rotatably supported; and a plurality of rotor blades arranged on an outer circumference of the turbine disk in a circumferential direction, and having a cooling passage inside, the turbine disk includes:

a plurality of first cooling holes that penetrates the turbine disk from inside toward outside thereof in a radial direction of the turbine disk, is communicatively connected to the cooling passage, and is arranged in the circumferential direction; and a plurality of second cooling holes that are arranged between each of the first cooling holes, and penetrates the turbine disk from the inside toward the outside thereof in a radial direction of the turbine disk, wherein base ends of the first cooling holes and the second cooling holes are configured to receive cooling gas, leading ends of the first cooling holes and the second cooling holes are communicatively connected to a radial direction communicating channel arranged in the circumferential direction, a plurality of fitting grooves arranged on an outer circumference in the circumferential direction are fitted with respective fitting protrusions on the rotor blades to form axial direction communicating channels in spaces between the fitting grooves and the rotor blades along an axial direction, the first cooling holes are arranged correspondingly to the axial direction communicating channels in the circumferential direction, and the leading ends thereof are communicatively connected to the radial direction communicating channel and the axial direction communicating channels, and the second cooling holes are arranged between the first cooling holes in the circumferential direction, and have the leading ends sealed, and are communicatively connected to the radial direction communicating channel.

* * * * *